United States Patent [19]

Tanaka et al.

[11] Patent Number: 4,787,563

[45] Date of Patent: Nov. 29, 1988

[54] BEARING SYSTEM FOR CONE TYPE CRUSHER

[75] Inventors: Takeshi Tanaka; Masao Jotatsu, both of Kobe, Japan

[73] Assignee: Kobe Steel, Ltd., Kobe, Japan

[21] Appl. No.: 640,558

[22] Filed: Aug. 15, 1984

Related U.S. Application Data

[63] Continuation of Ser. No. 564,359, Dec. 22, 1983.

[30] Foreign Application Priority Data

Nov. 17, 1979 [JP] Japan ..... 54-149717

[51] Int. Cl.[4] ..... B02L 2/04

[52] U.S. Cl. ..... 241/208; 241/215

[58] Field of Search ..... 241/207–216, 241/286, 290; 74/355, 416, 417, 420

[56] References Cited

U.S. PATENT DOCUMENTS

| | | | |
|---|---|---|---|
| 1,198,803 | 9/1916 | Wilson | 74/417 |
| 1,297,625 | 3/1919 | Willard et al. | 74/417 |
| 2,434,104 | 1/1948 | Esseling | 74/417 |
| 2,436,608 | 2/1948 | Rumpel | 241/208 |
| 2,579,516 | 12/1951 | Roubal | 241/215 |
| 2,833,486 | 5/1958 | MacLeod | 241/216 |
| 3,417,932 | 12/1968 | Patterson | 241/208 |
| 3,423,033 | 1/1969 | Durand | 241/215 X |
| 3,506,204 | 4/1970 | Kemnitz et al. | 241/208 |
| 3,771,735 | 11/1973 | Decker et al. | 241/216 |

FOREIGN PATENT DOCUMENTS

| | | | |
|---|---|---|---|
| 1303086 | 7/1962 | France | 241/216 |

OTHER PUBLICATIONS

*Primary Examiner*—Timothy V. Eley

*Attorney, Agent, or Firm*—Oblon, Fisher, Spivak, McClelland & Maier

[57] ABSTRACT

A cone type crusher which has a crushing chamber constituted by a crushing head assembly and a conical cap ring securely fitted in a fixed frame, the crusher including an eccentric drive cylinder for supportng therein and driving a vertical main shaft of the head assembly for gyration. The eccentric drive cylinder is supported by bearings which are located in two vertically spaced positions to preclude frictional wear due to metallic contacts, and is vertically movable for the purpose of adjusting the exit clearance of the crushing chamber.

4 Claims, 4 Drawing Sheets

BEARING SYSTEM FOR CONE TYPE CRUSHER

This is Continuation, of application Ser. No. 564,359, filed Dec. 22, 1983, now abandoned.

BACKGROUND OF THE INVENTION

1. Field of the Invention

This invention relates to cone type crushers.

More particularly, the invention concerns a bearing system for a cone type crusher assembly which is supported on the underside alone and free on its upper side, the bearing system preventing irregular wear of bearings due to metallic contact resulting from localized impact loads by means of cooperative action of vertically distributed bearing structures and a spherical bearing structure while in spite of its unique construction permitting free vertical movements of the rotary crusher assembly even under torque transmitting condition for adjustment of the exit clearance of the crushing chamber in automatic operations.

2. Description of the Prior Art

As illustrated in FIGS. 1 and 2, the cone type crusher of this sort generally includes a crusher support frame 1 with a fixed vertical cylinder 34 at the center of its bottom portion, and an eccentric drive cylinder 8 loosely fitted on the cylinder 34 and having a follower gear 6 around its eccentric outer periphery to gyrate a crusher assembly 20.

In such a crusher, it is the general practice not to support the upper side of the crusher assembly 20 by a bearing and to provide a bearing only between a bottom cylinder 35 of the crusher assembly 20 and the eccentric drive cylinder 8 for preventing the frictional wear from being localized to the inner wall surface of the fixed frame 1 under the influence of the feed material and by reason of unhindered, very smooth feeding of the material. In this case, the crushing load is imposed perpendicularly to the outer conical face of the crusher assembly 20 and the load moment is received in the direction in which the crusher 20 falls. Since the moment is received solely by a bearing 36 which is provided at one position in the conventional bearing structure as shown in the drawings, the cylindrical surface of the bearing 36 is brought into metallic contact with one side of the eccentric drive sleeve 8. As a result considerable localized frictional wear takes place not only on the bearing 36 but also on the surface of the eccentric drive cylinder 8. This detrimentally impairs the service life of the crusher and accelerates deteriorations in its crushing ability particularly in a crusher of the above-mentioned type which involves impact load and instrusion of crushed dust during operation.

In addition, the crusher assembly 20 is provided with not only a radial bearing but also a thrust bearing. In this connection, the conventional practice has been to provide a spherical bearing 37 on top of a cylindrical main shaft 15 which is passed through the eccentric drive cylinder 8. Therefore, the crushing load received by the spherical bearing 37 imposes a bending moment on the main shaft 15 or a main shaft bearing 16.

On the other hand, in order to cope with these problems, an attempt has been made to lessen the concentration of load on the bearing 36, supporting the spherical bottom face of the crusher assembly 20 on the fixed frame 1 as shown in FIG. 3, thereby by generating opposite resistant moment about the bearing 36. However, as seen in that figure, this arrangement does not permit movement of the main shaft 15 in the axial direction, and the upper portion of the fixed frame 1 has to be rotatingly adjusted by screws in order to adjust the exit clearance of the crushing chamber. It is therefore impossible to adjust the exit clearance automatically during the crushing operation. The adjustment of the exit clearance requires stoppage of the operation and involves jobs which are very troublesome and which take time and labor detrimentally to the efficient crushing opeation. Further, the complicated construction is apparently disadvantageous costwise.

SUMMARY OF THE INVENTION

The present invention has as its object the elimination of the above-mentioned difficulties and problems. It is a more particular object of the present invention to provide an improved bearing system for a cone type crusher assembly, which is simple in construction and permits adjustments of the exit clearance of the crushing chamber during crushing operation.

According to the present invention, there is provided a cone type crusher having a crushing chamber defined by a crushing head assembly and a conical cave ring securely fitted in a fixed frame, the crusher including an eccentric drive cylinder for supporting therein and gyrating a vertical main shaft of the crushing head assembly; a torque transmitting mechanism for gyrating the eccentric drive cylinder; a lift mechanism for moving the eccentric drive cylinder up and down in the axial direction thereof; bearing assembly located in vertically spaced middle and lower positions on the fixed frame for supporting the eccentric drive cylinder; and a spherical bearing member provided between the top and bottom ends of the eccentric drive cylinder and the crushing head assembly, respectively.

The above and other objects, features and advantages of the invention will become apparent from the following description and the appended claims, taken in conjunction with the accompanying drawings which show by way of example a preferred embodiment of the present invention.

DETAILED DESCRIPTION OF THE PREFERRED EMBODIMENT

Figure 1:
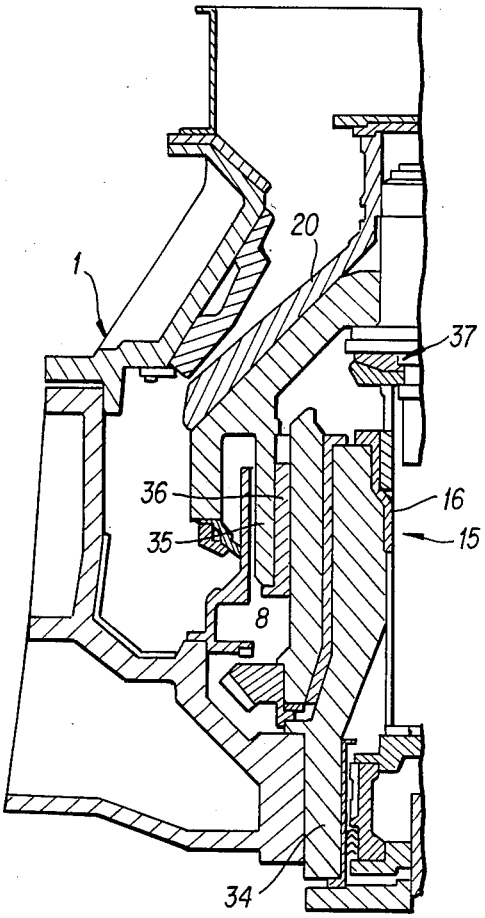
FIG. 1 PRIOR ART
FIGS. 1 to 3 are diagrammatic sectional views of conventional cone type crushers.
Figure 2:
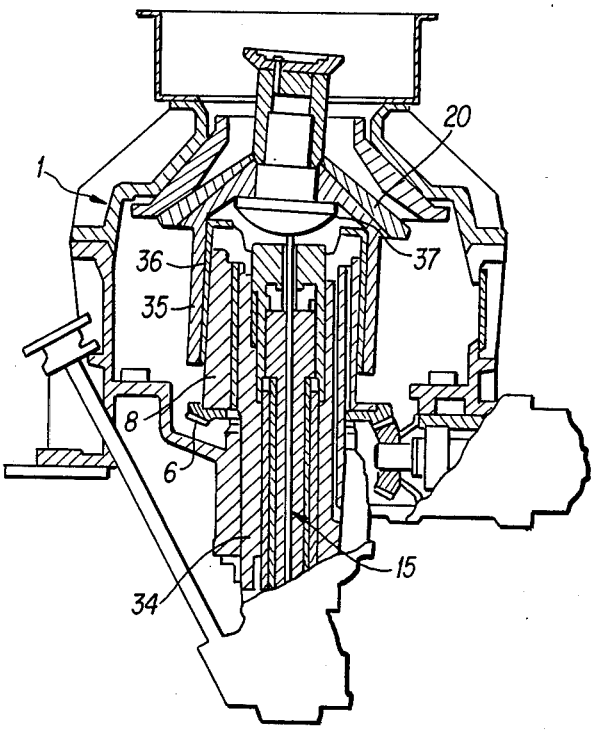
FIG. 2 PRIOR ART
Figure 3:
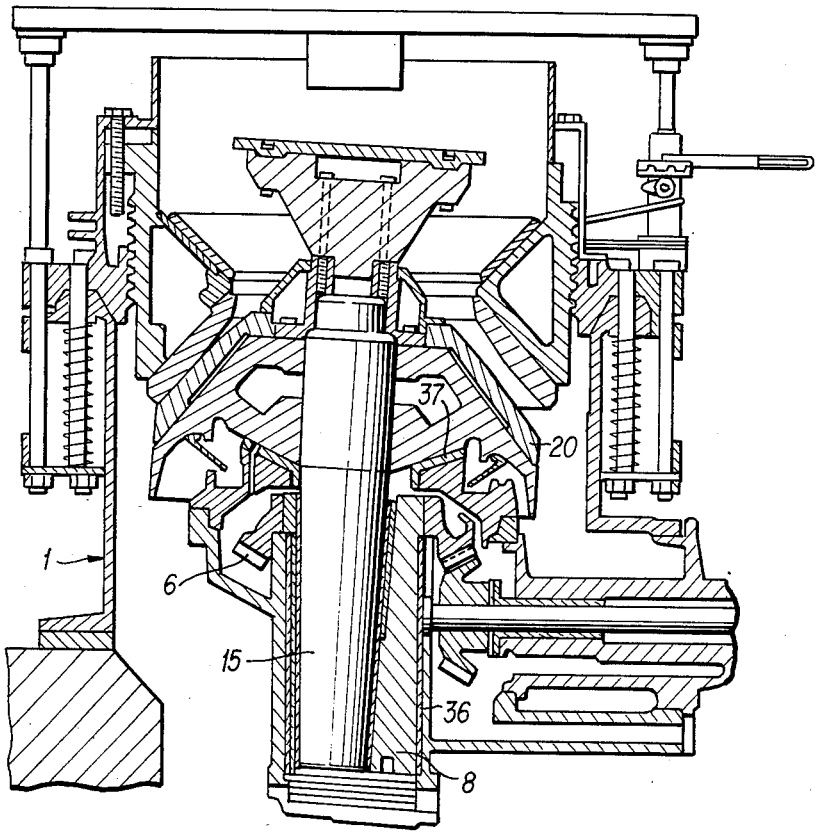
FIG. 3 PRIOR ART
Figure 4:
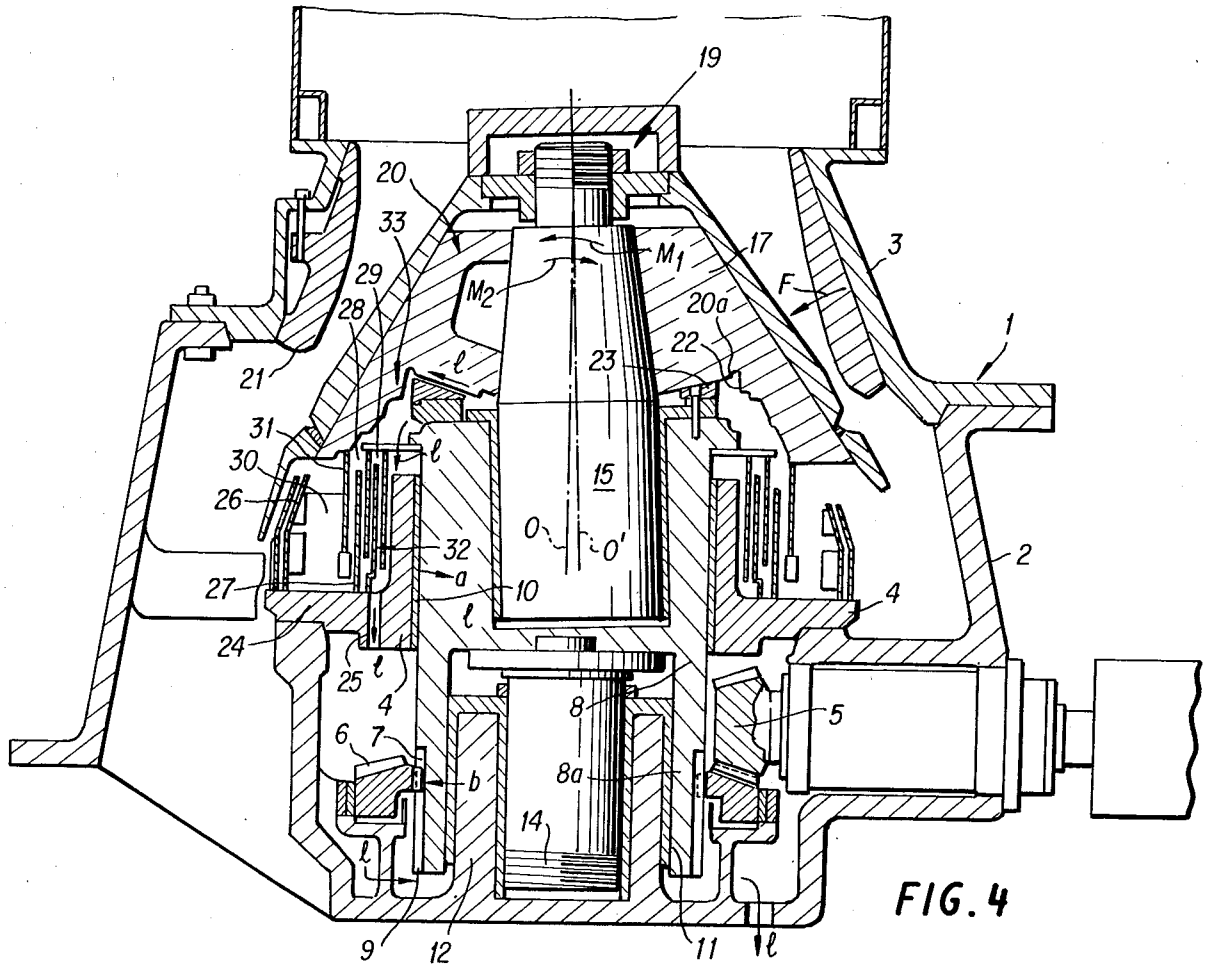
FIG. 4 is a diagrammatic sectional view of a crusher embodying the present invention.

Referring to FIG. 4 which shows a crusher according to the present invention, indicated at reference number 1 is a barrel type fixed frame forming an outer housing of the crusher and consisting of a lower frame 2 and an upper frame 3 which is fixed on the lower frame 2. The lower frame 2 is centrally provided with an inner housing 4 fixedly and coaxially with the outer housing about the center (O) of the crusher, and receives at one side of its lower portion a drive shaft assembly with a drive pinion 5 at the inner end thereof and rotatable about a fixed axis.

Denoted by reference number 6 is a follower gear which is provided on the bottom of the fixed frame 1 with its rotational axis in alignment with the center of the crusher (O). The follower gear 6 is rotatably supported by thrust and radial bearings and meshed with the drive pinion 5 for rotation at a predetermined level.

A plurality of axially splines 7 formed on the inner periphery of the follower gear 6 engage with a spline gear 9 which is formed in the lower portion of the outer periphery of a cylindrical eccentric drive cylinder 8 to permit relative axial movements of the latter. The eccentric drive cylinder 8 is supported on the outer periphery of its upper half portion by the inner housing 4 which is provided with a cylindrical upper bearing 10 over the entire inner periphery thereof.

Opposingly to the upper bearing 10, a cylindrical lower bearing 11 is fitted between a cylinder 12 which is integrally projected from the bottom of the fixed frame 1 and a downwardly opened cylinder 8a forming the lower portion of the eccentric drive cylinder 8, the lower bearing 11 being substantially fixed to the cylinder 12.

The cylinder 12 slidably receives therein a piston 14 which is movable up and down to adjust the position of the eccentric drive cylinder 8. The lower portion of a main crusher shaft 15 is inserted in the upper half portion of the drive cylinder 8 in a slightly tilted position relative to the center of the crusher (O). The main crusher shaft 15 is rotatable about its axis through a main bearing 16 on the outer periphery thereof.

The main crusher shaft 15 has a conical head center 17 fitted on the outer periphery of its upper half portion and a mantle 18 integrally held on the outer periphery of the head center 17 by a head lock 19 to form a crushing head assembly 20. The crushing head assembly 20 which opposes cone cap ring 21 on the inner periphery of the upper frame 3 has no bearing at its free top end.

The crushing head assembly 20 is provided with a downwardly diverging conical recess 22 on the underside thereof to receive the top end of the eccentric drive cylinder 8 which is fixedly provided with a spherical seat 23 of a concave ring type.

On the other hand, the bottom end of the crushing head assembly 20 terminates in a spherical face 20a which has its center at the apex of the cone formed by the mantle 18.

In order to enhance the resistance to frictional wear of the upper bearing 10 and other component parts, the inner housing 4 is provided with a horizontal flange 24 beneath the crushing head assembly 20, the flange 24 having axial oil circulating holes 25 on its inner periphery and mounting thereon a fixed outer cylinder 26 in the form of double rings, a fixed intermediate cylinder 28 located spacedly on the inner side of the outer cylinder 26 and having a communicating port 27, and a fixed inner cylinder 29 located on the inner side of the intermediate cylinder 28. These cylinders 26, 28 and 29 which form triple concentrical rings about the center of the crusher (O) are tall and close enough to the crushing head assembly 20 to form a liquid pool 30 of annular shape in plan view but allowing for gyrating movement of the crushing head assembly 20. The pool 30 holds an ordinary liquid and receives between the outer and intermediate cylinders 26 and 28 a cylinder 31 which extends downward from the bottom end of the head center 17 of the crushing head assembly 20 concentrically with the center of inclination (O'), a substantial portion of the cylinder 31 being rotatably dipped in the liquid pool 30 to form a perfect bearing seal. Indicated at reference number 32 is lower seal, at reference number 33 an upper seal, and l denotes the route of circulation of the bearing lubricating oil.

A crushing load F acting on the crushing head assembly 20 normally produces a moment in the main shaft 15 according to the force F to cause metallic contact to the main shaft bearing 16 by a one-sided load. However, with the abovedescribed bearing system of the invention, the one-sided loadcarrying phenomenon of the main shaft bearing 16 would not occur, since the moment $M_1$ due to the force F is offset by the opposite moment $M_2$ which is generated through the spherical seat 23 provided on top of the eccentric drive cylinder 8. In this connection, the conventional counterpart which has the spherical seat on the main shaft 15 has been unable to eliminate the onesided load carrying by the bearing.

The crushing load F itself is imposed through the eccentric drive cylinder 8 to act on its outer periphery alone. The upper and lower bearings 10 and 11 located in vertically spaced positions suppress vibrations of the eccentric drive cylinder 8 to be kept to a minimum and preclude the one-sided load-carrying phenomenon, in contrast to the conventional crusher which has the main shaft bearing only in one position. In addition, since the reaction force occurs not only in the upper portion a but also in the distant lower portion b, the pressure which is imposed on the respective bearings is very small, that is to say, only a light force is supported by surface contact with the respective bearings, with no possibilities of localized frictional wear. Thus, the bearing system for the rotational operation is entirely protected against the metallic contact due to one-sided loading.

As is clear from the foregoing description, the present invention contributes to enhance the durability of the bearing system in a cone crusher and, by the employment of the liftable crushing head assembly, it becomes possible to adjust the exit clearance of the crushing chamber freely at any time, permitting automation of the crushing operation.

Obviously, numerous modifications and variations of the present invention are possible in light of the above teachings. It is therefore to be understood that within the scope of the appended claims, the invention may be practiced otherwise than as specifically described herein.

What is claimed is:

1. A cone type crusher having a vertical main axis, said crusher comprising:

(a) a barrel type outer frame;

(b) a cap ring mounted on said outer frame;

(c) an inner frame fixedly mounted on said outer frame;

(d) a drive shaft assembly fixedly mounted on said outer frame;

(e) a drive pinion rotatably driven by said fixedly mounted drive shaft assembly;

(f) a horizontally disposed follower gear mounted in said inner frame for rotation about the vertical main axis of the crusher and in position to engage said drive pinion, said follower gear having a plurality of radially inwardly projecting, vertically oriented axial splines formed thereon;

(g) a drive cylinder mounted for vertical motion along the vertical main axis of the crusher, said drive cylinder having a spline gear formed thereon which engages said plurality of radially inwardly projecting axial splines formed on said horizontally disposed follower gear, said spline gear being sized and shaped to receive rotary torque from said splines and to permit said drive cylinder to move vertically relative to said follower gear at the same time that said spline gear is receiving rotary torque from said splines;

(h) a cylindrical upper bearing which supports the upper portion of said drive cylinder, said cylindrical upper bearing being located radially outwardly of said drive cylinder and between said drive cylinder and said inner frame;

(i) a cylindrical lower bearing which supports the lower portion of said drive cylinder, said cylindrical lower bearing being located radially inwardly of said drive cylinder and between said drive cylinder and said outer frame;

(j) lift means for axially moving said drive cylinder along the vertical main axis of the crusher at the same time that said spline gear is receiving rotary torque from said splines, during which vertical motion said drive cylinder slides vertically in both said cylindrical upper bearing and said cylindrical lower bearing and said spline gear slides vertically relative to said plurality of radially inwardly projecting axial splines on said horizontally disposed follower gear;

(k) a main crusher shaft generally vertically mounted in said drive cylinder, said main crusher shaft being rotatable about an eccentric axis disposed at a small angle relative to the vertical main axis of the crusher;

(l) a crushing head mounted on said main crusher shaft in position to define a crushing chamber in cooperation with said cap ring; and (m) an annularly shaped spherical thrust bearing disposed between said crushing head and said drive cylinder radially outwardly of said main crusher shaft, whereby, (n) when said lift means is activated to move said drive cylinder vertically, there is relative axial movement between said horizontally disposed follower gear and said spline gear, but the axis of rotation of said drive pinion remains fixed;

(o) a moment on one side of said main crusher shaft produced by an asymmetric load on said crushing head is offset by an opposite moment acting through said annularly shaped spherical thrust bearing; and (p) said cylindrical upper and lower bearings reduce vibrations of said drive cylinder to a minimum and distribute radial thrusts produced by loads in said crushing chamber over a large contact surface area.

2. A crusher as recited in claim 1 wherein said lift means comprise a fluid piston and cylinder operatively disposed along the vertical main axis of the crusher and bearing at one end against said drive cylinder and the other end against said outer frame.

3. A crusher as recited in claim 1 and further comprising a main bearing disposed between said main crusher shaft and said drive cylinder.

4. A crusher as recited in claim 1 and further comprising a labyrinth type lubrication seal operatively disposed between said inner frame and said crushing head.

* * * * *